US007914719B2

(12) United States Patent
Sommer et al.

(10) Patent No.: US 7,914,719 B2
(45) Date of Patent: Mar. 29, 2011

(54) PROCESS FOR THE MANUFACTURE OF A SPUN FLEECE MADE OF FILAMENTS

(75) Inventors: Sebastian Sommer, Troisdorf (DE); Jens Guedden, Troisdorf (DE)

(73) Assignee: Reifenhaeuser GmbH & Co., Maschinenenfabrik, Troisdorf (DE)

( * ) Notice: Subject to any disclaimer, the term of this patent is extended or adjusted under 35 U.S.C. 154(b) by 970 days.

(21) Appl. No.: 11/050,680

(22) Filed: Feb. 7, 2005

(65) Prior Publication Data

US 2005/0173842 A1 Aug. 11, 2005

(30) Foreign Application Priority Data

Feb. 9, 2004 (DE) ..... 10 2004 006 373

(51) Int. Cl.

| | |
|---|---|
| ***D01D 5/08*** | (2006.01) |
| ***D01D 5/34*** | (2006.01) |
| ***D01F 1/10*** | (2006.01) |
| ***D01F 8/06*** | (2006.01) |
| ***D04H 3/10*** | (2006.01) |

(52) U.S. Cl. ..... 264/103; 28/104; 264/172.15; 264/211; 264/211.13; 264/211.12

(58) Field of Classification Search ..... 264/103, 264/172.15, 211, 211.13, 211.2; 28/104
See application file for complete search history.

(56) References Cited

U.S. PATENT DOCUMENTS

| | | | | |
|---|---|---|---|---|
| 4,548,628 | A | 10/1985 | Miyake et al. | |
| 5,151,320 | A * | 9/1992 | Homonoff et al. | 28/104 X |
| 5,422,159 | A * | 6/1995 | Fagan | 28/104 X |
| 6,506,873 | B1 * | 1/2003 | Ryan et al. | 264/172.15 X |
| 7,455,800 | B2 * | 11/2008 | Ferencz et al. | 264/103 |
| 2003/0203695 | A1 * | 10/2003 | Polanco et al. | 442/365 |
| 2004/0010894 | A1 | 1/2004 | Goldwasser | 28/104 |

FOREIGN PATENT DOCUMENTS

| | | |
|---|---|---|
| DE | 696 00 069 | 9/1996 |
| EP | 0 814 188 | 12/1997 |
| EP | 0 878 854 | 11/1998 |
| EP | 1 382 731 | 1/2004 |

* cited by examiner

*Primary Examiner* — Leo B Tentoni
(74) *Attorney, Agent, or Firm* — Jonathan Myers; Andrew Wilford

(57) ABSTRACT

Process for the manufacture of a spun fleece web made of filaments and particularly made of filaments made of thermoplastic synthetic material. The filaments are spun out of a mixture comprising at least one polymer and at least one hydrophilic additive and are plaited to form the fleece web. The fleece web is heated to a temperature of at least 30° C. and/or moistened with an aqueous liquid. The fleece web is thereafter hydrodynamically compacted.

8 Claims, 1 Drawing Sheet

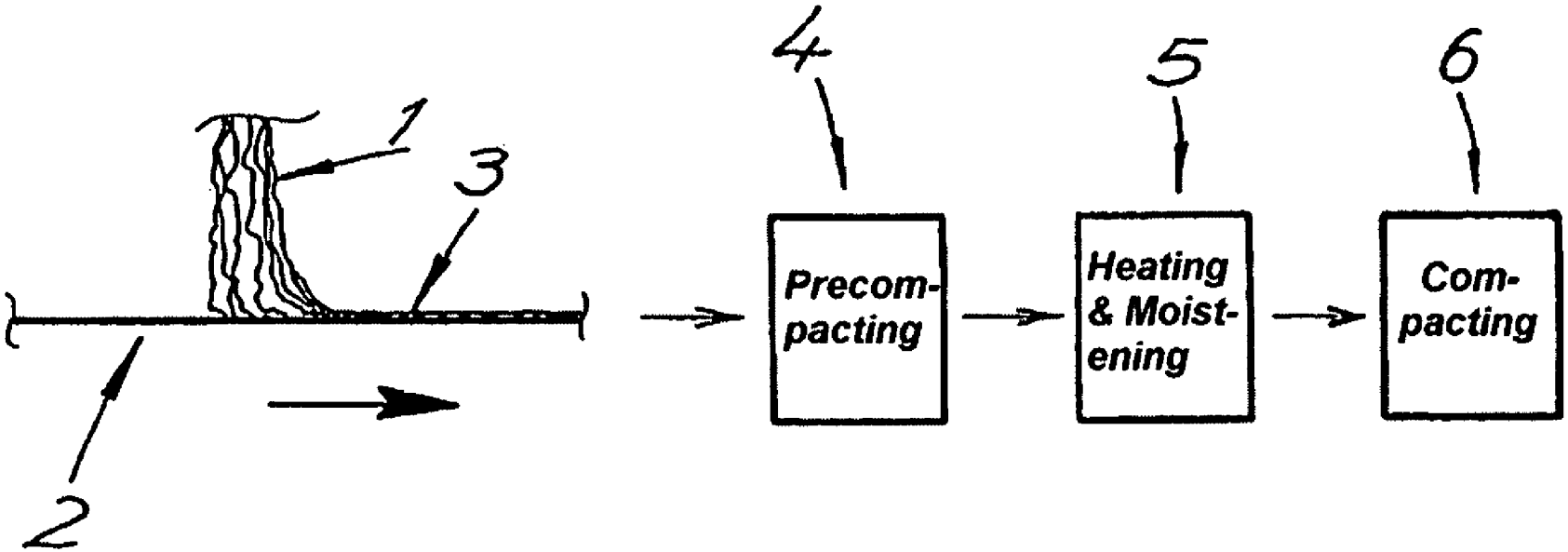
Precom-
pacting
Heating
& Moist-
ening
Com-
pacting
1
2
3
4
5
6

PROCESS FOR THE MANUFACTURE OF A SPUN FLEECE MADE OF FILAMENTS

FIELD OF INVENTION

The invention relates to a process for the manufacture of a spun fleece made of filaments and particularly made of filaments made of thermoplastic synthetic material where the filaments are formed into a fleece web and that is hydrodynamically compacted. Filaments in the context of the invention means endless fibers, i.e. theoretically infinitely long threads from which the fleece web and/or the spun fleece is formed. Within the context of the invention the fleece web and/or the spun fleece is continuously formed out of the filaments.

DESCRIPTION OF RELATED ART

There is basically known a prior-art method of hydrodynamically compacting a fleece web made of filaments and/or of subjecting such a fleece web to water-jet compacting. The filaments of the fleece web are however frequently hydrophobic and/or have a hydrophobic outer surface. This applies particularly in the case of filaments made of polyolefins, for example made of polyethylene or polypropylene. Due to the hydrophobic character the effectiveness of the impulse transfer of water to the filaments during water-jet compacting often leaves much to be desired. To this extent the prior-art process requires improvement.

SUMMARY OF THE INVENTION

Accordingly the technical problem of the invention is to provide a process of the type cited at the outset with which effective hydrodynamic compacting is achievable also in the case of hydrophobic filaments and/or in the case of hydrophobic filament outer surfaces.

BRIEF DESCRIPTION OF THE DRAWINGS

FIG. 1 shows a sequence of process steps according to one embodiment of the invention process.

DETAILED DESCRIPTION OF THE INVENTION

In order to solve this technical problem the invention provides a process for the manufacture of a spun fleece made of filaments and particularly made of filaments of thermoplastic synthetic material where the filaments are spun out of a mixture of at least one polymer and at least one hydrophilic additive and the filaments are formed into a fleece web that is heated to a temperature of at least 30° C. and/or moistened with an aqueous liquid and the fleece web is thereafter hydrodynamically compacted.

Within the context of the invention a thermoplastic polymer and/or thermoplastic polymers are used as a polymer for the filaments. Further within the context of the invention the filaments are comprised primarily of this polymer and/or of these polymers. In a preferred embodiment the filaments consist of only thermoplastic polymers.

According to a particularly preferred embodiment of the invention the mixture from which the filaments are spun consists of at least up to 90% by weight and preferably at least 95% by weight of the polymer. Preferably the filaments consist of more than 95% by weight of the polymer. The mixture from which the filaments are spun expediently contains 0.1 to 5% by weight and preferably 0.1 to 3% by weight and particularly preferably 0.15 to 2.5% by weight of the hydrophilic additive. Preferably the polymer and the hydrophilic additive are different materials. The aforementioned polymer (from which the filaments primarily consist) is a not-hydrophilic and/or not sufficiently hydrophilic polymer that is however hydrophilically modifiable. This polymer is particularly preferably a polyolefin and preferably polyethylene or polypropylene. This polymer however can also be a polyester or for example a polyamide. Within the context of the invention the hydrophilic additive is also a polymer and namely a hydrophilic polymer. According to a particularly preferred embodiment of the invention the mixture from which the filaments are spun with reference to concentration and/or type of the ingredients is to be adjusted such that after a storage time of 3 to 9 days and preferably of 4 to 8 days and particularly preferably of 5 to 7 days the surface tension of the filaments changes/would change by at least 5 mN/m.

As stated above the hydrophilic additive according to a preferred embodiment of the invention is a hydrophilic polymer. Within the context of the invention the hydrophilic additive is an ethoxylated organic compound and/or an ethoxylated polymer. According to a particularly preferred embodiment of the invention at least one hydrophilic additive from the group "polyalkylene oxide, polyalkylene oxide compound, ethoxylated silicon, ethoxylated siloxane, ethoxylated hydrocarbon, ethoxylated fluorocarbon" is used. In the event that a polyalkylene oxide is used it can be polyethylene oxide according to one embodiment. Within the context of the invention modified polymers can be used as a hydrophilic additive with polyalkylene oxide.

The filaments for the fleece web according to the invention can be mono-component filaments and/or bi-component filaments and/or multi-component filaments. The bicomponent filaments and/or multi-component filaments may comprise an end-to-end structure or a core-sheath structure. According to a particular embodiment of the invention hollow fibers are used as filaments for the fleece web according to the invention.

According to a very particularly preferred embodiment of the invention multi-component filaments and preferably bi-component filaments are spun that comprise a core-sheath structure wherein the hydrophilic additive is present in the sheath component. In this case in the context of the invention the hydrophilic additive is exclusively present in the sheath component of these bi-component filaments and/or multi-component filaments.

A particularly preferred embodiment of the process in accordance with the invention is characterized in that at least a portion of the filaments are spun as spliceable multi-component filaments and preferably bi-component filaments wherein the hydrophilic additive is in at least one of the components and that at least a portion of the spliceable multi-component filaments is spliced during the hydrodynamically compacting. Spliceable multicomponent-filaments and/or bi-component filaments means particularly filaments whose components consist of incompatible polymer components. At least one polymer component in these multi-component filaments is spun out of a mixture of the polymer and a hydrophilic additive. That the spliceable multi-component filaments are spliced during the hydrodynamic compacting means in the context of the invention that these filaments are spliced over at least a portion of their length. The presently described embodiment is of very particular importance. Surprisingly because of a better wetting of the multi-component filaments during the hydrodynamic compacting the splicing can be executed with a lower energy outlay in comparison to the prior art measures. This is naturally a significant advantage. The spliceable multi-component filaments used in the context of the invention comprise an end-to-end structure or a segmented-pie structure (also described as orange-type and/or orange structure). These multi-component filaments can be present as solid fibers or as hollow fibers.

Particularly preferable in the context of the process in accordance with the invention is the use of a hydrophilic additive which hydrophilic additive comprises a different solubility within the individual components of the multi-component filaments. Particularly preferred in this case is a hydrophilic additive which hydrophilic additive by way of the different solubility in the individual components of the multi-component filaments concentrates in the phase thresholds and thereby lowers the threshold adherence. Thereby in the case of the hydrodynamic compacting of spliceable multi-component filaments a particularly effective splicing is achieved.

Of very particular importance is one embodiment of the process in accordance with the invention which embodiment in accordance with the invention is characterized in that the fleece web is pre-compacted prior to its heating and/or moistening. This pre-compacting can be executed thermally or mechanically, for example by means of needle felting. Basically the pre-compacting can also be hydrodynamically executed.

According to a preferred embodiment of the invention the fleece web formed out of the filaments is heated to a temperature of at least 35° C. and preferably of at least 40° C. Within the context of the invention the fleece web is heated up to a temperature of 20° C. below the melting point of one of the filament outer surfaces of the filament-forming polymer. In the case that the polymer forming the filament surfaces is polyethylene and/or polypropylene the fleece web is expediently heated to a temperature of up to 100° C.

The aqueous liquid with which the fleece web is moistened is preferably pure water or water with which at least one surfactant substance is mixed in order to facilitate the wetting of the (hydrophobic) filaments. The fleece web is expediently moistened and/or sprayed with a heated aqueous liquid with the proviso that the fleece web is heated to a temperature of at least 20° C., preferably at least 25° C. and particularly preferably at least 30° C. According to a preferred embodiment of the invention the fleece web at a temperature of at least 20° C. and preferably of at least 25° C. and particularly preferably of at least 30° C. is moistened with the aqueous liquid. The moistening of the fleece web is expediently brought about at a temperature of 35° C. and preferably at a temperature of at least 40° C. Within the context of the invention the fleece web at such an increased temperature is kept moist until or until shortly before the hydrodynamic compacting. According to a particularly preferred embodiment of the invention the fleece web is moistened with the aqueous liquid which aqueous liquid is heated to a temperature of at least 20° C. and preferably to a temperature of at least 25° C. and particularly preferably to a temperature of at least 30° C. Expediently the moistening of the fleece web is brought about with aqueous liquid which aqueous liquid is heated and/or preheated to a temperature of at least 35° C. and preferably to a temperature of at least 40° C. Within the context of the invention the moisturizing of the fleece web is brought about with preheated water. A spraying of the fleece web with the liquid and/or an immersing of the fleece web in the liquid can be brought about and/or a steaming of the fleece web with water steam. Aqueous liquid in the context of the invention also means water in the form of steam.

Within the context of the invention the hydrodynamic compacting of the fleece web is brought about by means of water-jet treatment. In the case of this water-jet compacting and/or water-jet needle felting fine very fast water jets compact the fleece. According to an embodiment of the invention the hydrodynamic compacting is brought about immediately after the other process steps according to the invention and more particularly preferably immediately after the heating and/or moistening of the fleece web. Thus the process occurs as it were inline i.e. the manufacture of the fleece web and/or of the spun fleece is brought about continuously and without interruption.

According to a further embodiment of the invention however the process can also be executed offline i.e. with an interruption of the process step sequence. In this case it is within the context of the invention that work is executed offline wherein the fleece web is stored before the hydrodynamic compacting at a temperature of at least 30° C. and/or subject to moistening with an aqueous liquid. The fleece web after the heating and/or moistening heated can be rolled while moist and preferably the rolled fleece web is then stored in a temperature-controlled room for example for several hours or several days. The storage temperature is thereby expediently at least 30° C. and preferably at least 40° C. In the event that the filament outer surfaces consist of a polyolefin and particularly of polypropylene or polyethylene the storage temperature is preferably 40° C. to 100° C. Within the context of the invention the fleece web is kept moist during the storage for example by means of storing in an atmosphere with high moisture content and/or with high humidity. Basically however the fleece web must be stored warm wherein for example it is rolled into a heater blanket.

The invention is based on the discovery that in the case of a fleece web consisting of filaments with a hydrophilic additive there can be brought about after the pre-treatment according to the invention by means of heating and/or moistening a very effective hydrodynamic compacting and/or water-jet compacting. In the case of such a pre-treated fleece web in accordance with the invention there is achieved in the case of hydrodynamic compacting a surprisingly effective impulse transfer of the water to the filaments.

Hereafter the invention is described in further detail on the basis of a single exemplified embodiment-illustrating drawing. The single figure shows the sequence of process steps according to the invention in schematic format.

The spun filaments 1 are laid onto a receiving surface which receiving surface is formed as an endlessly rotating plaiting screen 2 to form the spun fleece web 3. The spun fleece web 3 is then transported in the direction of the arrow and initially arrives at a treatment station 4 where it is pre-compacted. The pre-compacting can be brought about for example thermally. The spun fleece web 3 is then fed to the second treatment station 5. In this second treatment station 5 the web 3 is both heated and moistened.

Expediently the spun fleece web 3 is treated with water which water is pre-heated for example to 50° C. Thereafter the spun fleece web 3 is fed into a compacting device 6 wherein the hydrodynamic compacting is brought about. I.e. a fleece compacting is brought about by means of water-jet treatment and/or by means of treatment with high-pressure water jets. In the context of the process in accordance with the invention the hydrodynamic compacting can be brought about surprisingly effectively.

German Application No. 102004006373.7 filed on Feb. 9, 2004 is incorporated herein by reference in its entirety.

Obviously, numerous modifications and variations of the present invention are possible in light of the above teachings. It is therefore to be understood that within the scope of the appended claims, the invention may be practiced otherwise and as specifically described herein.

The invention claimed is:

1. A process for the manufacture of a spun fleece made of bi-component or multi-component filaments of polyolefin having a core-sheath structure, wherein a hydrophilic additive is present exclusively in the sheath component, comprising the steps of sequentially;

(a) spinning the bi-component or multi-component filaments of polyolefin having a core-sheath structure out of a mixture of at least one polyolefin and at least one hydrophilic additive, to obtain the filaments containing as the core component the at least one polyolefin, and as the sheath component the at least one polyolefin, and also containing the hydrophilic additive;

(b) forming the spun filaments into a fleece web;

(c) thereafter in a separate step precompacting the fleece web;

(d) thereafter in a separate step heating the precompacted fleece web to a temperature of 40 to 100° C. to obtain the spun fleece made of the filaments of polyolefin containing as the core component the at least one polyolefin, and as the sheath component the polyolefin, wherein the sheath component exclusively contains the hydrophilic additive; and (e) thereafter in a separate step hydrodynamically compacting the heated and precompacted fleece web through impulse transfer of the water to the filaments.

2. The process according to claim 1 wherein the polyolefin is polyethylene or polypropylene.

3. The process according to claim 1 wherein the hydrophilic additive is a polyalkylene oxide, ethoxylated silicon, ethoxylated siloxane, ethoxylated hydrocarbon, or ethoxylated fluorocarbon.

4. A process for the manufacture of a spun fleece made of bi-component or multi-component filaments of polyolefin having a core-sheath structure, wherein a hydrophilic additive is present exclusively in the sheath component, comprising the steps of sequentially (a) spinning the bi-component or multi-component filaments of polyolefin having a core-sheath structure out of a mixture of at least one polyolefin, and at least one hydrophilic additive, to obtain the filaments containing as the core component the at least one polyolefin, as the sheath component the at least one polyolefin, and also containing the hydrophilic additive;

(b) forming the spun filaments into a fleece web;

(c) thereafter in a separate step precompacting the fleece web;

(d) thereafter in a separate step heating the precompacted fleece web to a temperature of 40 to 100° C., and moistening the precompacted fleece with an aqueous liquid heated to a temperature of at least 40° C. to obtain the spun fleece made of the filaments of polyolefin containing as the core component the at least one polyolefin, and as the sheath component the polyolefin, wherein the sheath component exclusively contains the hydrophilic additive; and (e) thereafter in a separate step hydrodynamically compacting the heated and precompacted fleece web through impulse transfer of the water to the filaments.

5. The process according to claim 4 wherein the polyolefin is polyethylene or polypropylene.

6. The process according to claim 4 wherein the hydrophilic additive is a polyalkylene oxide, ethoxylated silicon, ethoxylated siloxane, ethoxylated hydrocarbon, or ethoxylated fluorocarbon.

7. A process for the manufacture of a spun fleece made of bi-component or multi-component filaments of polyolefin having a core-sheath structure, wherein a hydrophilic additive is present exclusively in the sheath component, comprising the steps of sequentially (a) spinning the bi-component or multi-component filaments of polyolefin having a core-sheath structure out of a mixture of at least one polyolefin, at least one of which is selected from the group consisting of polyethylene and polypropylene and at least one hydrophilic additive, to obtain the filaments containing as a core component the at least one polyolefin, as a sheath component the polyolefin selected from the group consisting of polyethylene and polypropylene, and also containing the hydrophilic additive, wherein the hydrophilic additive is present exclusively in the sheath component;

(b) forming the spun filaments into a fleece web;

(c) thereafter in a separate step precompacting the fleece web;

(d) thereafter in a separate step heating the precompacted fleece web to a temperature of 40 to 100° C. to obtain the spun fleece made out of the filaments of polyolefins containing as the core component the at least one polyolefin, as the sheath component the polyolefin selected from the group consisting of polyethylene and polypropylene, wherein the sheath component exclusively contains the hydrophilic additive; and (e) thereafter in a separate step hydrodynamically compacting the heated and precompacted fleece web through impulse transfer of the water to the filaments.

8. The process according to claim 7 wherein the hydrophilic additive is a polyalkylene oxide, ethoxylated silicon, ethoxylated siloxane, ethoxylated hydrocarbon, or ethoxylated fluorocarbon.

* * * * *